US006065721A

United States Patent [19]

Sumpton et al.

[11] Patent Number: 6,065,721

[45] Date of Patent: May 23, 2000

[54] SWITCH CLEARING SYSTEM

[76] Inventors: Danny M Sumpton, P.O. Box 612; Michel A Lepage, P.O. Box 760, both of Capreol, Ontario, Canada, POM 1HO

[21] Appl. No.: 09/061,908

[22] Filed: Apr. 17, 1998

[51] Int. Cl.[7] ..... E01B 7/00

[52] U.S. Cl. ..... 246/428; 246/444; 104/279

[58] Field of Search ..... 246/428, 444; 104/279, 280; 239/207, 602

[56] References Cited

U.S. PATENT DOCUMENTS

| | | | |
|---|---|---|---|
| 1,273,291 | 7/1918 | Vaughan | 246/428 |
| 1,778,637 | 10/1930 | Hollinger | 246/428 |
| 3,484,601 | 12/1969 | Burwell | 246/428 |
| 3,612,409 | 10/1971 | Henning | 239/602 |
| 3,972,497 | 8/1976 | Ringer | 246/428 |
| 4,360,949 | 11/1982 | Wilson | 104/279 |
| 4,674,718 | 6/1987 | Bjorklund | 246/428 |
| 4,695,017 | 9/1987 | Ringer et al. | 246/428 |
| 5,702,074 | 12/1997 | Smith et al. | 246/428 |

FOREIGN PATENT DOCUMENTS

| | | | |
|---|---|---|---|
| 4-189901 | 7/1992 | Japan | 246/428 |

*Primary Examiner*—Mark T. Le
*Attorney, Agent, or Firm*—D. W. Eggins

[57] ABSTRACT

An sir blowing system for use in deeping railroad track switches clear of snow utilizes flexible tubes, preferebly of rubber or plastic, located transversely beneath the main tracks, and connecting with resilient nozzles to direct a high flow of air in the direction of the track switch points. The system may include resilient ducts conveying air in protective relation with the switch control rods, extending laterally beneath the track. The rod protective air discharge may be by way of a louvered cross-tube, extending parallel with the rods, to discharge air laterally of the rods, or one or more nozzles discharging air longitudinally of hte rods.

17 Claims, 6 Drawing Sheets

16
16
76
75
38
37
17
18
36
70
70
32
34
79
80
80
78
70
76
74
75
70

SWITCH CLEARING SYSTEM

BACKGROUND OF THE INVENTION

1. Field of the Invention

This invention is directed to a safety system for clearing a switch of air-born pollution, and in particular to a system for keeping a railroad switch clear of snow, to promote its sage operation.

2. Description of the Prior Art

Extensive use is presently being made in railway systems located in snow belt areas such as the more northerly States of the United States and in Canada, of air blowing systems, for keeping track switches of rail systems clear of snow, deposited directly and by induced drafting from trains. Track switches comprise movable twin portions of rail track that can be laterally pivoted to guide the flanged wheels of rolling stock from one track to an adjacent track, enabling the diversion of a train or its component cars from one track to another.

Such systems are vulnerable to becoming inoperative, or defectively operable in the presence of snow deposits. Snow is readily deposited between the fixed rails and the adjacent, movable switch points rail portions.

These snow deposits can prevent the full, unrestricted motion of the switch points from one operative position to another operative position, with grave and dangerous consequences. Numerous examples exist of prior art switch point air-blowing arrangements, such as U.S. Pat. Nos: 2,898,062 Magnus, August 1959; 3,972,497 Ringer, August 1976; 4,081,161 Upright, March 1978; 4,671,475; Widmer, June 1987; 4,674,718 Bjorklund, June 1987; 4,695,017 Ringer et al, September 1987 The current state of prior art is exemplified in Ringer et al U.S. Pat. No. 4,695,017 (referred to below a "U.S. '017").

U.S. '017 shows a fan for providing a high velocity mass flow of amvient air, connected by way of rectangular-section metal conduits to first, second, and possibly third stage air blowing nozzles, to blow high belocity air substantially horizontally into the gap between the switch points nad the respective stock (main) rails, in sufficient mass and at a sufficiently high velocity to keep the switch clear of snow, deposited both naturally, and by train-generated turbulence. The systems are most generally operated continuously during the snow season.

The conduits extend transversely of the road bed, below the rails and between the rail ties, with nozzles extending upwardly from the conduits, projecting above the level of the cross ties of the track, to about the height of the switch rails.

In accordance with the relevant official technical specification for the former Canadian National Railway, CN-066-SM 1991 Edition, the conduits and nozzles of these systems are of galvanized sheet metal, each installtion generally requiring to be custom-built.

The nozzle and duct potions of these existing systems have been found to be prone to being accidentally damaged, from impacts against the upstanding nozzles by equipment dragging from passing trains, and by the operation or passage of track maintenance equipment, etc.

Damage occurring to the nozzles per se, which are sometimes torn away, frequently causes widespread damage to the connection conduits, the removal, repair and replacement of which is vary labour intensive and expensive, particularly in view of the custom-built aspect of their construction. Attempts to cope with this type of damage, by making the nozzles more robust and rigid, has been found in many instances to lead to increased consequential damage to the attached air conduits, with increased repair requirements. In instances of track maintenance, where the air blowing system requires temporary removal and replacement, a number of hours and considerable effort is usually required for removal and subsequent re-installation of the conduits and nozzles.

A further major disadvantage of these types of prior art systems is the use of galvanized metal conduit, located transversely below the stock rails, making electrical contact with the undersides of the stock rails. Normally, in most railways where air blower systems are installed, the stock rails are utilized as conductors for the control of track signal lights.

Accordingly, the respective portions of air conduit are connected by way of an electrical insulation break. The insulation, however, is prone to becoming contaminated, and electrically bridged. When this short circuit occurs, the system fails "safe", and the associated signal lights all go to the RED condition. This halts ass trains, causing a tremendous adverse impact upon the flow of rail traffic. Under these circumstances railroad regulations require, for each halted train, the obtaining of a written authorization to proceed under emergency conditions, and consequent passage across the affected zone of the track at 15-mile an hour, instead of being able to highball through, non-stop, at normal track speed for that section of the system.

Typically, for a 10-mile section of affected track, one train delayed 45-minutes will cost many thousands of dollars. With trains each averaging about 90-cars, extending about 5,000 feet, the economic losses associated with stopping, obtaining authorization to pass, and proceeding at reduced speed over the affected track zone, are very high.

As regards effecting temporary removal, of carrying out repairs on a damaged prior-art conduit-and-nozzle system, these may well be required in the depths of winter, possibly after dark, with minimal facilities and under semi-arctic conditions. In a worst-case scenario involving more than a nozzle, the conduit may have to be unbolted from the fan unit or from its output conduit an futher dis-assembled into its smaller component lengths by unbolting an array of bolts or capscrews at the flanged joints where necessary, to enable drawing of those portions from veneath the stock rails, for repair or replacement. This typically comprises a three-hour or more job for the repair person. The removal job may be further complicated by deformation or tearing of the conduit, from the initial, damaging impact against the nozzel.

A further major deficiency of existing, prior art systems, is an apparent total absence of provision to deep transverse track, actuator and indicator rods clear of snow. The transverse rods of a switch system comprise spacer rods connecting the two rail portions of the switch, to deep them parallel to each other, and actuator and indicator rads connecting the switch rails to the positioning mechanism, by which the switch is operated.

The complex structure of these rods, necessitated by the need to provide a wide range of adjustability, makes them vulnerable to jamming. Thus, the accumulation of snow, and/or consequential ice, about the transverse rods of a switch system can redily immobilize a switch against effective operation.

In summary, it can be readily appreciated that the currently used systems are highly prone to damage, and suffer from further major disadvantages, with the potential liability of becoming inoperable; of partially disabling the railway system, and of being difficult to service and to repair.

SUMMARY OF THE INVENTION

The present invention provides a pollutant dispersion system for dispersing air-born pollutants from the vicinity of a switch means, the system including at least one laterally flexible intermediate air conducting tubular member, a source of forced air, and at least one air directing nozzle, the intermediate tube being connected in air conducting relation between the air source and the air nozzle, in use to direct a mass flow of air in pollutant-dispersing relation adjacent a first working zone, the first working zone including component portions of the switch means that theobject malfunction in the presence of the pollutant.

In the aforesaid dispersion system, the switch means comprises railroad switch points, wherein the at least one tubular member extends beneath stock rails of a railroad track, the track incorporation the switch means. In the dispersion system, the flexible intermediate member is elastic, preferably a substantially circular, flexible cylindrical tube of elastomer, the preferred elastomer being rubber.

The switch means may form part of a railroad track having a pair of stock rails, wherein a least a portion of the intermediate tube is located beneath at least one stock rail of the track.

The nozzles of the system are preferably of rubber. Joints for the conduit system may be off-the-shelf standard automotive metal exhaust or muffler components such as connectors, elbows and clamps.

The system air dispersion nozzles may be removably secured to the stock rails of a railroad track, wherein the switch is installed, by way of conduit attachment means.

The conduit attachment means may be removable; and also adjustable, enabling the height of the supported conduit or nozzle to be selectively adjusted.

The switch system in the case of a railroad switch, may be equipped with transverse switch rods, usually comprising spacer, actuator ("front") and indicator transverse rods, wherein at least one air nozzled is directed to supply high velocity air blowing over and adjacent transverse rod in contaminant displacing relation relative to the rod, to maintain mobility and serviceability of the rod.

In one embodiment a rod, which extends laterally of the track, being located between the ties of the track, may have an air conduit extending substantially parallel with the rod; the conduit having a plurality of nozzles directed obliquely towards the rod, to direct a sufficient mass of air at a sufficient velocity to disperse air-born contamination from the immediate vicinity of the rod, to thereby diminish the likelihood of the rod being immobilized by the contaminant. A further embodiment may comprise one or more conduits discharging air transversely of the track, along a rod.

The predominant contaminant is snow.

The use of other forms of tubing is contemplated. In the case of hybrid of metallic flexible conduit, akin to clothes-dryer exhaust hose, the outer surface thereof may be readily insulated by way of tape or a split rubber gaiter ant the locations where the conduit lays under the rails of the track point.

BRIEF DESCRIPTION OF THE DRAWINGS

Certain embodiments of the present invention are described by way of illustration, without limitation of the invention thereto, other than as set forth in the accompanying claims, reference being made to the accompanying drawings, wherein:

DESCRIPTION OF THE PREFERRED EMBODIMENTS

Figure 1:
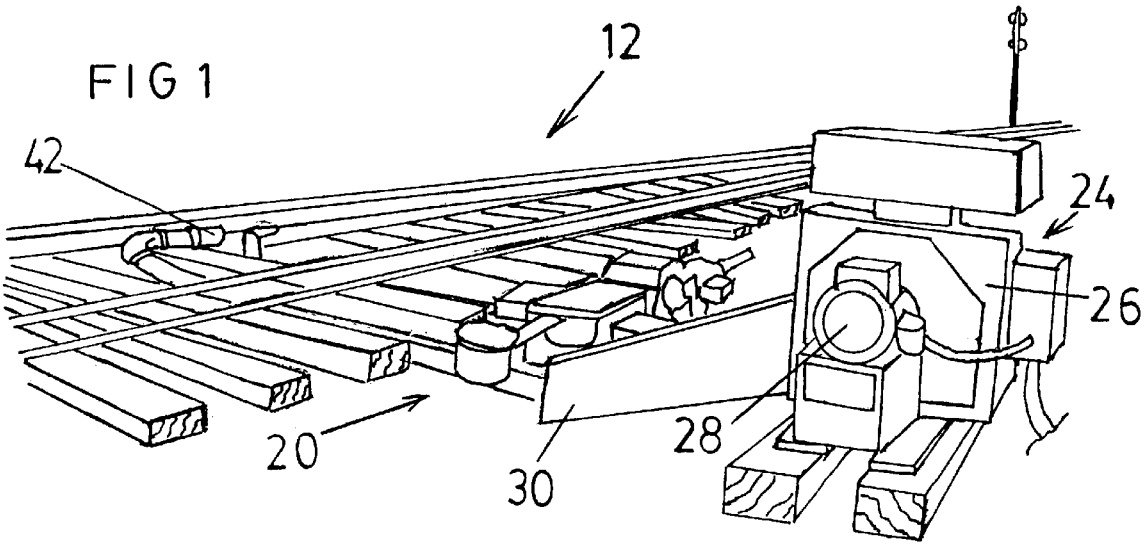
FIG. 1 is a perspective sketch, in end-view of an air blower unit for use with the present invention.
Figure 2:
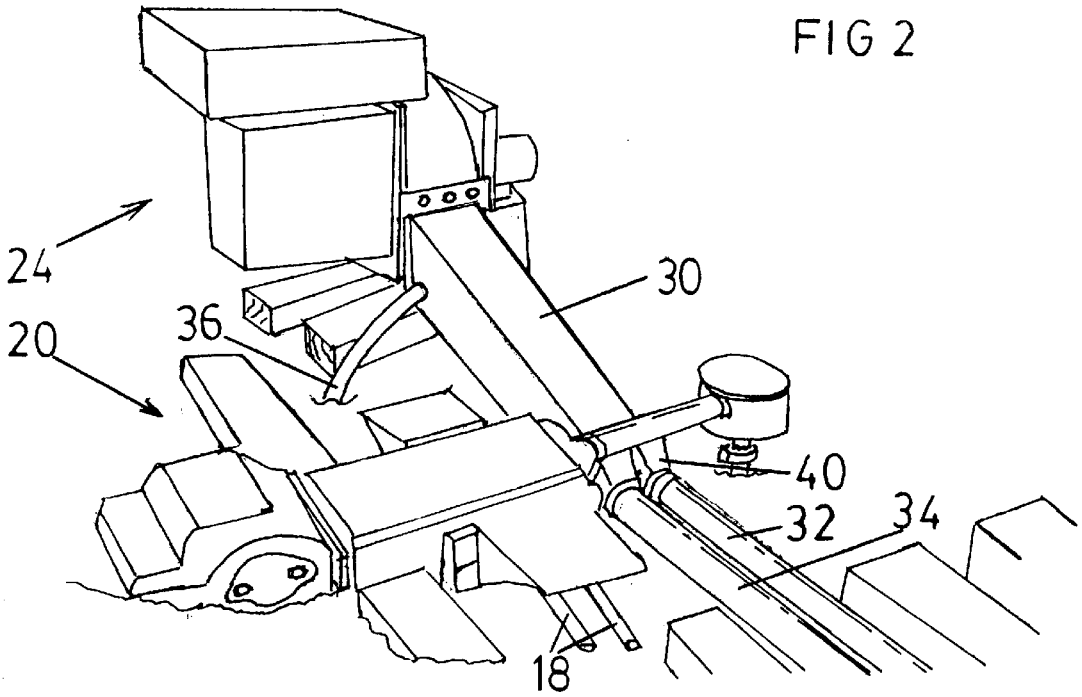
FIG. 2 is a frontal perspective view of the FIG. 1 embodiment, showing elements of the subject system.
Figure 3:
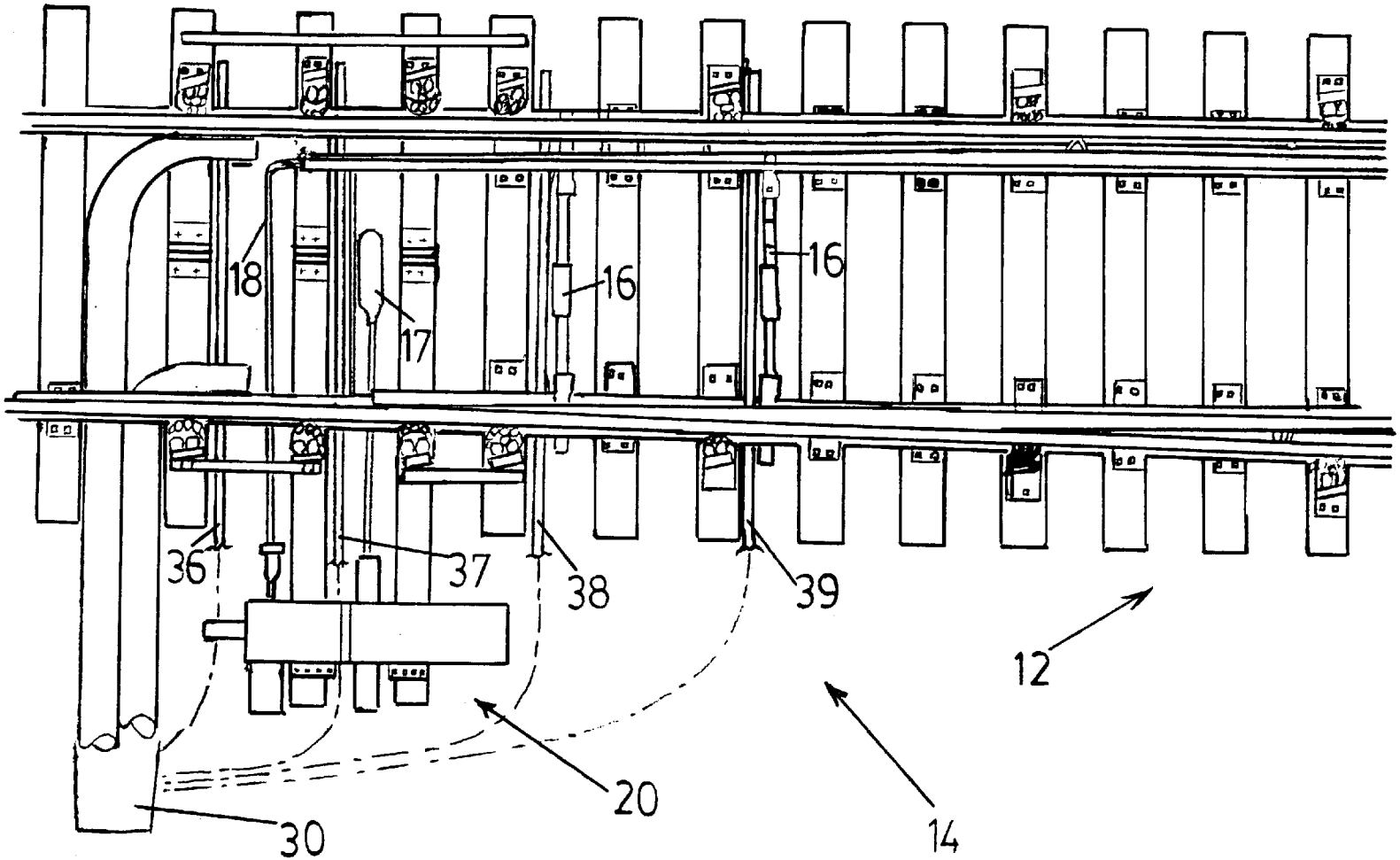
FIG. 3 is a plane view of the track portion of FIG. 1.

Referring to FIGS. 1, 2 and 3, a railroad track 12 incorporates a switching rail system 14. Spacer rods 16 maintain the switch rails parallel. Switch actuating rod 17 and switch position indicator rod 18 connect the movable switch members of the track 12 to an electrically driven switch mechanism 20 located at track-side.

An air blower unit 24 comprising a fan 26, is directly driven by an electric motor 28. The unit 24 provides a mass flow of high velocity ambient air.

An air manifold 30 connects the air blower unit 24 with the air distribution tubes 32, 34, 36, 37, 38 and 39 of the system first embodiment.

The main output to tubes 32, 34 is by way of a bi-furcated Y-adaptor 40.

Figure 4:
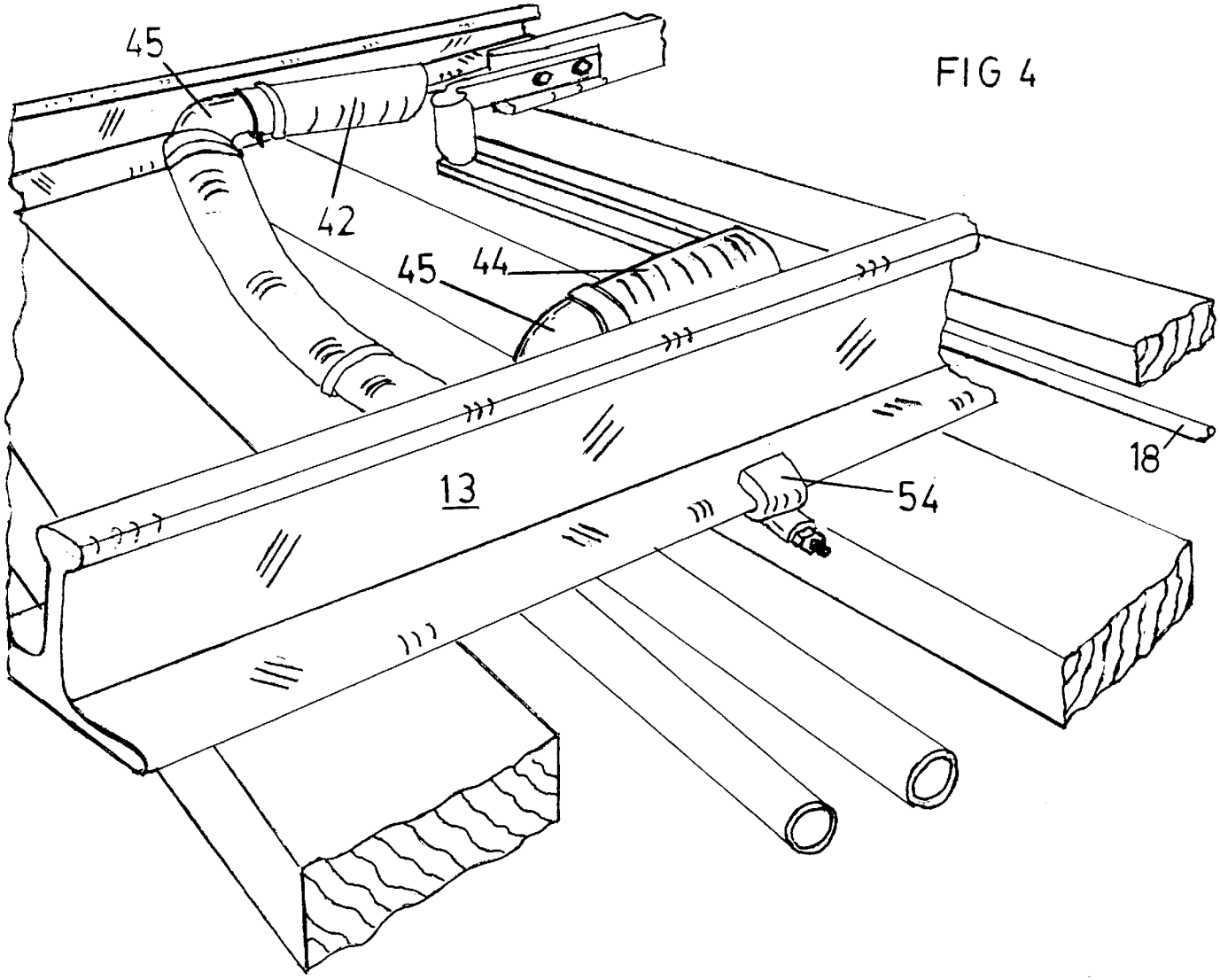
FIG. 4 is an enlarged perspective view of a portion of FIG. 3.
Figure 5:
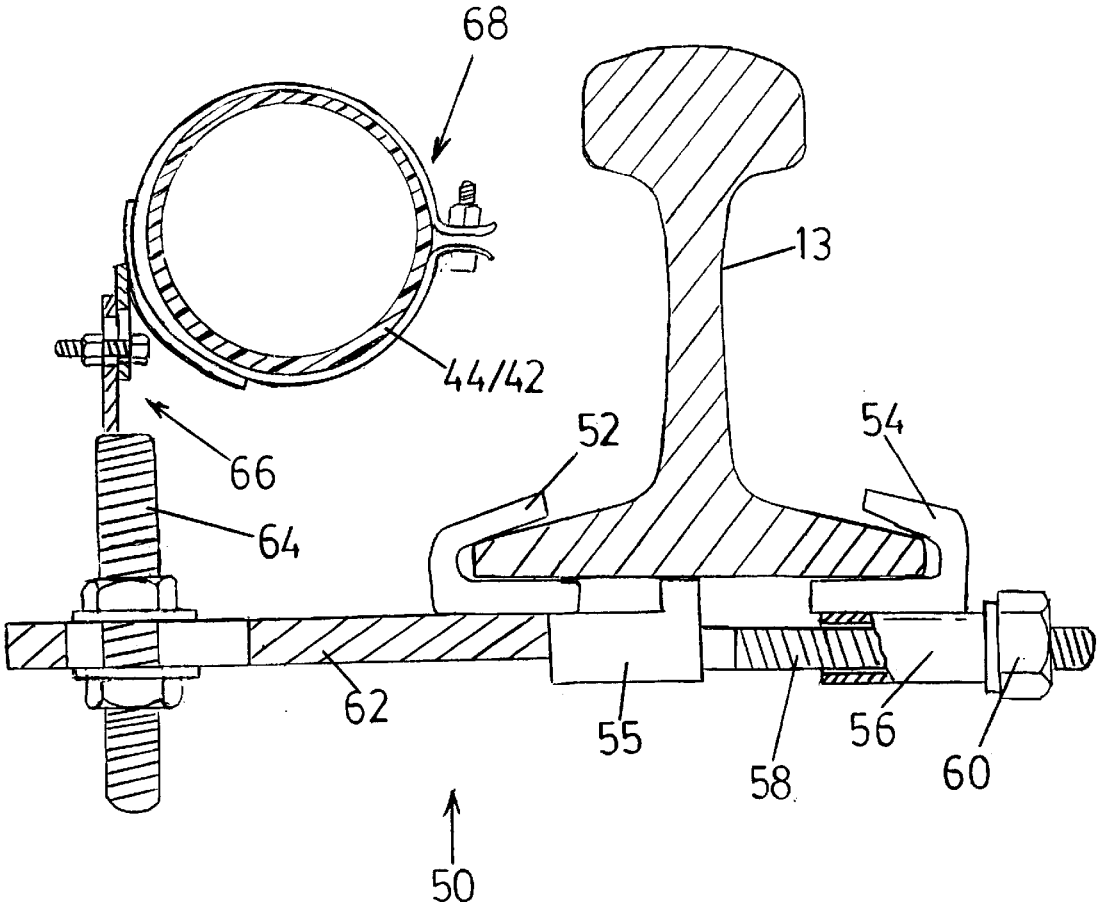
FIG. 5 is an end view, in part-section, of a support bracket holding a nozzle secured to a rail.

The main tubes 32, 34 are of an elatomer, some 4-inches in diameter, and connect with nozzles 42, 44 (see also FIGS. 4 and 5). Rubber tubes have been found to be suitable. The tubes 32, 34 are readily passed beneath the track rails 13, and are connected by way of metallic elbows 45 with their respective nozzles 42, 44. The use of plastic connectors is contemplated.

The tube 32–39 are held by stainless steel pipe clamps. The nozzles 42, 44, which are preferably of rubber, are clamped to the track rails 13 by way of clamp assembly 50. Each clamp assembly 50 comprises a pair of bits 52, 54 attached to an L-shaped base member 55. The adjustable bit 54 is slideably mounted by way of sleeve 56 upon bole portion 58.

Adjustment of mut 60 inables opening and closing of the bits 52, 54, to grip the bottom flange of the track rail 13. A slotted extension piece 62 carries threaded post 64, from which extends an adjustable mount 66. A clamp 68 attached to mount 66 receives a nozzle 42 or 44 in secured relation therein.

The threaded post 64 is both laterally, vertically and rotatably adjustable upon the slotted extension piece 62. Further vertical adjustability is provided by the adjustable mount 66. The left or right handing of the tube clamp 68 can be achieved at post 64, or at the adjustable mount 66. Referring to FIG. 3, four rod-protection blower tubes 36, 37, 38 and 39 are connected by 2-inch diameter rubber hose (shown in phantom lines) with the air output duct 30.

Each blower tube 36–39 has a series of side outlets directed towards the vicinity of the adjacent rod, to disperse any falling snow clear of the rod.

Figure 6:
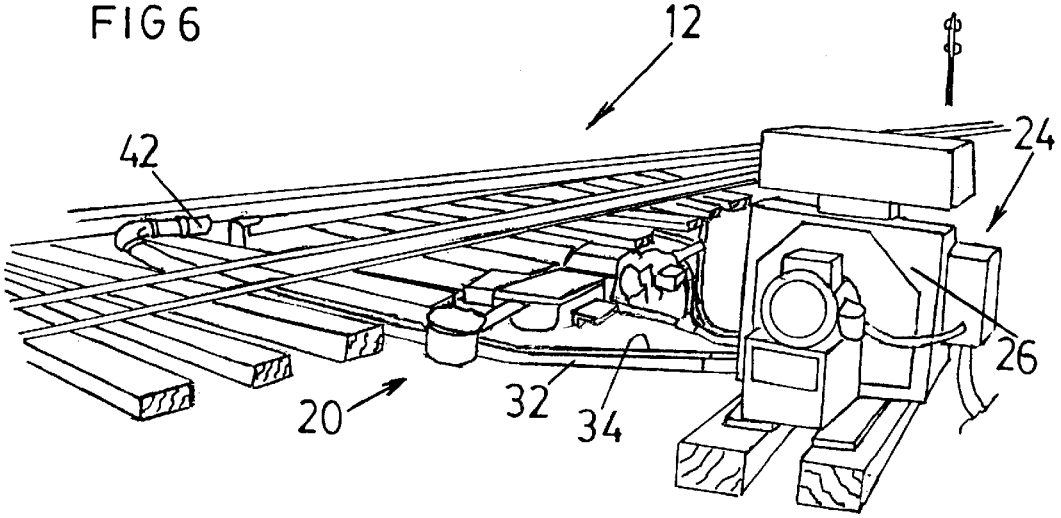
FIG. 6 is a view similar to FIG. 1, of an embodiment with further rod-blowing provisions.
Figure 7:
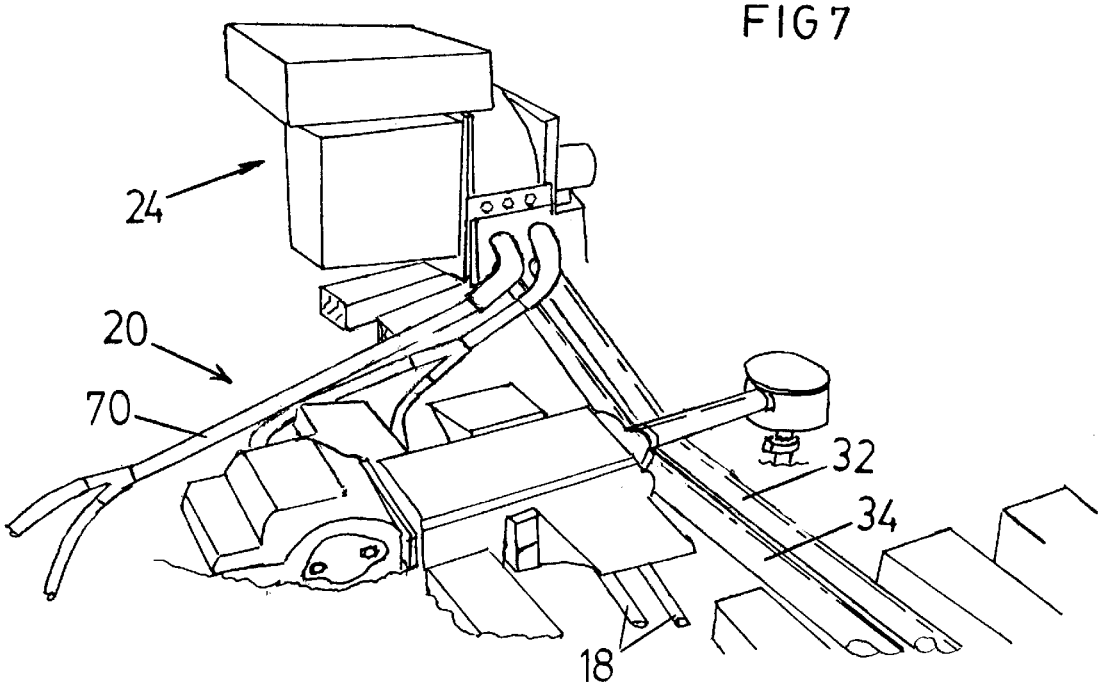
FIG. 7 is a view similar to FIG. 2, of the FIG. 6 embodiment.
Figures 8, 9:
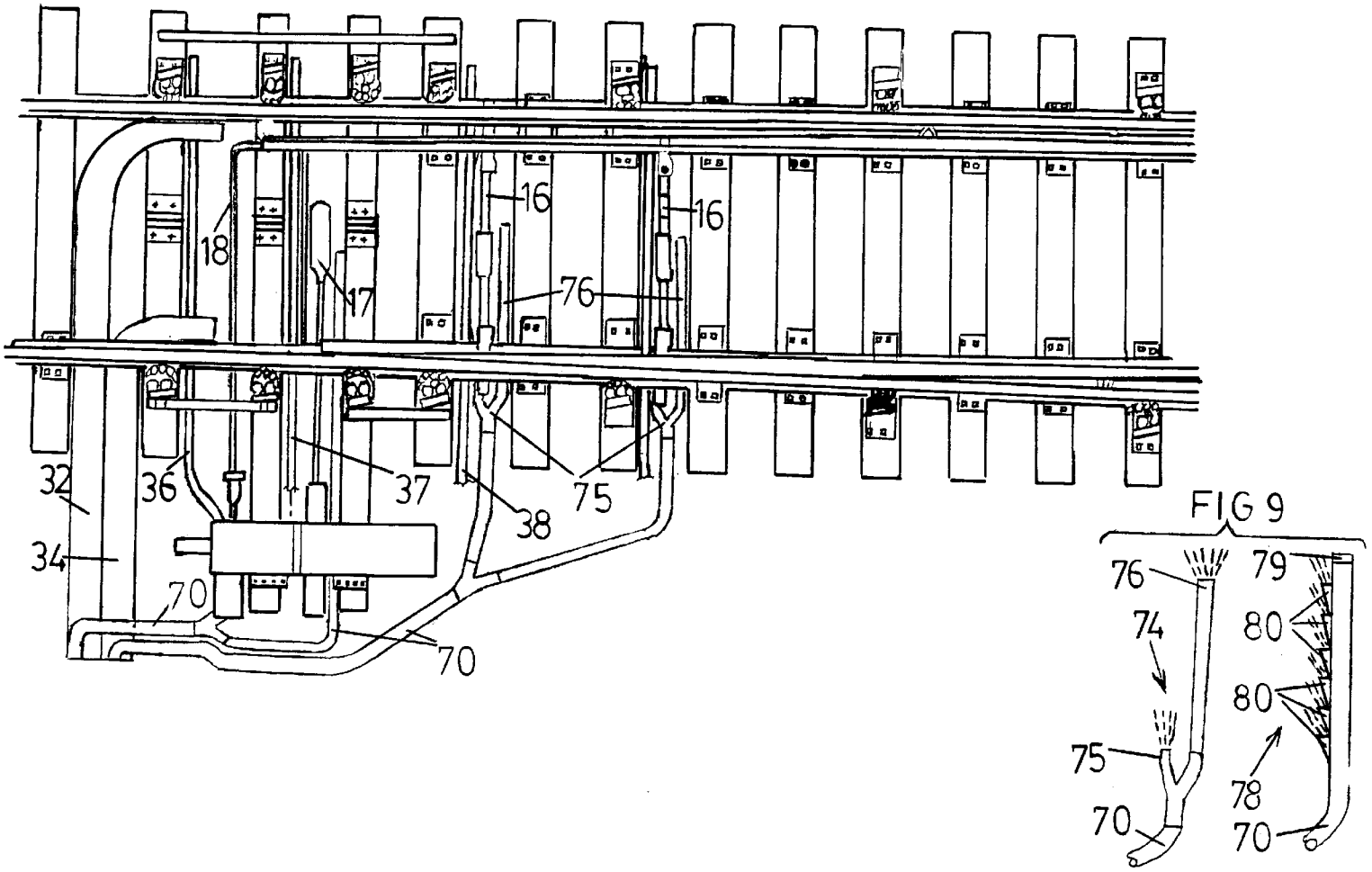
FIG. 8 is a view similar to FIG. 3, showing the rod blowing provisions of FIGS. 6 & 7; and, FIG. 9 is a plan view of two types of rod blowing nozzles.

Turning to FIGS. 6, 7 and 8, these show alternative air connection provisions by way of hose lines 70.

The two-inch rubber hoses are connected by way of low-cost, standardized metal automotive fittings and clamps (not shown) with Y-connectors 72.

Referring to FIG. 9, the rod-blower installation 74 has a pair of plain nozzles 75, 76 directed laterally of the track; the complementary or alternative embodiment 78 has an end cap 79 and a series of obliquely directed nozzles 80.

Initial installation, removal, repair and/or replacement of the hose, nozzle and clamp components, is readily and rapidly effected, with a minimum of tools or effort.

In instances of nozzles suffering impact from something dragging from a train it has been found that a rubber nozzle may be form without seriously affecting the connected air supply tube, or the substantial operation of the torn nozzle.

The use of smooth round tubes has been found to ensure effective air flow, despite having a smaller cross-sectional area than the previous rectangular metal ducting.

Comparative field tests were carried out on an operating railroad system, using an ambient air system.

The hose and nozzle system of the present invention were substituted for the prior art conduit an nozzles previously used in an older system. No changes were made to the forced air supply. The installation comprised an actual switch point, in an "open" condition.

Air velocity measurements (in Km per hour) were taken at the nozzle and at a succession of stations from the switch point to its heel, with intermediate points A, B and C:

| | @ NOZZLE | @ POINT | @A. | @B. | @C | @HEEL |
|---|---|---|---|---|---|---|
| Prior art system: | 107 | 78 | 57 | 16 | 6 | 1–2 |
| Present Invention system: | 111 | 111 | 106 | 42 | 28 | 8 |

The test is only indicative, as cross wind conditions were not constant for both tests.

The loading of the blower motor was measurably the same for both system tests, giving clear indication of substantially equal rates of air displacement through each system.

It is contemplated that the benefits of the present invention as practically demonstrated are also realizable with a system utilizing hot air.

It will be understood by those skilled in the art that certain variations and/or modifications of the present invention may be made, within the scope of the present claims. Also, the system has wide potential use against air-born contamination, including snow and other elements, for systems where the low cost, flexibility and lightness of the air tubes and nozzle components, allied with their selective electrical non-conductivity and play important roles.

What is claimed is:

1. A pollutant dispersion system for dispersing air-born pollutants from a permanent route-altering switch points installation, in combination with said switch points installation, the system including at least one laterally flexible intermediate elastomeric tubular member located in readily removable, inserted relation beneath portions of said switch points installation, a forced air supply and at least one air directing nozzle, said nozzle being secured in predetermined relation adjacent said switch points, said tubular member being connected in air conducting relation between said air supply and said air nozzle, in use to direct at least one air jet in pollutant-dispersing relation with said switch points to substantially preclude an accumulation of said pollutant and consequent malfunction of said switch points.

2. A pollutant dispersion system for dispersing air-born pollutants from railroad switch points of a railroad track, in combination with said railroad track switch points, the system including at least one laterally flexible intermediate tubular member, a forced air supply and at least one air directing nozzle, said tubular member being connected in air conducting relation between said air supply and said air directing nozzle, in use to direct at least one air jet in pollutant-dispersing relation with a first working zone, said first working zone containing component portions of said switch points, which are subject to malfunction in the presence of an accumulation of said pollutant, wherein at least one said flexible tubular member extends beneath a stock rail of said railroad track, said switch points operating in conjunction with said track.

3. The dispersion system of claim 2, said flexible intermediate tubular member being a substantially circular cylindrical elastic tube.

4. The dispersion system of claim 3, said elastic tube being of elastomer.

5. The dispersion system of claim 3, said elastic tube being of rubber.

6. The dispersion system of claim 3, said elastic tube being being selected from tubes in the size range one and one half inches to six inches in diameter.

7. The dispersion system as set forth in claim 2, said at least one nozzle being of elastomer.

8. The dispersion system as set forth in claim 7, said at least one nozzle being secured to a stock rail of said railroad track.

9. The dispersion system as set forth in claim 8, wherein said at least one air directing nozzle is adjustably secured to said stock rail of said railroad track, to provide adjustment capability to said nozzle in height and direction relative to said first working zone.

10. The dispersion system as set forth in claim 2, said system including at least one switch means transverse rod, said nozzle being directed to supply forced air in contaminant displacing relation relative to said transverse rod.

11. The dispersion system of claim 2, said tubular, flexible intermediate member being electrically insulative, relative to said rails.

12. A pollutant dispersion system for dispersing air-born pollutants from switch means of a route-changing switch system, in combination with said switch system, the dispersion system including at least one elastomeric tubular intermediate member, a source of forced air, and at least one air directing nozzle, said intermediate tube being located beneath elements of said switch system in air conducting relation between said air source and said air nozzle, in use to direct a continuous air flow in pollutant-dispersing relation with a first working zone, said first working zone including component portions of said switch means that are subject to malfunction in the presence of an accumulation of said pollutant said switch means comprising railroad switch points having at least one rod portion connected thereto, said air directing nozzle being secured adjacent said at least one rod portion, to direct air in pollution dispersing relation, relative to said at least one rod portion.

13. The dispersion system of claim 12, said at least one rod portion being selected from the group consisting of spacer, actuator and indicator transverse rods.

14. The dispersion system of claim 13, said intermediate tubular member being a substantially circular cylindrical tube of elastomer.

15. The dispersion system of claim 13, said at least one air direction nozzle comprising an elongated, transversely extending first nozzle located adjacent a said transverse rod and a second said nozzle of short extent directed against the proximal end of said transverse rod.

16. The dispersion system of claim 15, said at least one air directing nozzle comprising an elongated, transversely extending first nozzle located adjacent a said transverse rod and having an open end thereof directed transversely of said railroad.

17. The dispersion system of claim 15, said at least one air directing nozzle comprising an elongated, transversely extending first nozzle located adjacent a said transverse rod and having the distal end thereof capped, and a plurality of obliquely directed nozzles spaced along at least a portion of its length, to discharge air over a said rod located in adjacent relation thereto, to displace said pollutant away from said rod.

* * * * *